US012311251B2

(12) United States Patent
Button

(10) Patent No.: US 12,311,251 B2
(45) Date of Patent: May 27, 2025

(54) PORTABLE LINE ASCENDING DEVICE FOR SLIDING OR ROLLER SPORTS

(71) Applicant: Robert Button, Richmond (CA)

(72) Inventor: Robert Button, Richmond (CA)

( * ) Notice: Subject to any disclaimer, the term of this patent is extended or adjusted under 35 U.S.C. 154(b) by 1022 days.

(21) Appl. No.: 17/229,626

(22) Filed: Apr. 13, 2021

(65) Prior Publication Data

US 2022/0323850 A1 Oct. 13, 2022

(51) Int. Cl.

| | |
|---|---|
| ***A63C 11/10*** | (2006.01) |
| ***B61B 11/00*** | (2006.01) |
| *B61B 7/06* | (2006.01) |
| *B61B 12/12* | (2006.01) |

(52) U.S. Cl.

CPC ..... *A63C 11/10* (2013.01); *B61B 11/00* (2013.01); *B61B 11/002* (2013.01); *B61B 11/004* (2013.01); *B61B 11/006* (2013.01); *B61B 11/008* (2013.01); *B61B 7/06* (2013.01); *B61B 12/127* (2013.01)

(58) Field of Classification Search

CPC ..... A63C 11/10; B61B 11/00; B61B 11/002; B61B 11/004; B61B 11/006; B61B 11/008; B61B 12/127; B61B 7/06

USPC ..... 104/173.2

See application file for complete search history.

(56) References Cited

U.S. PATENT DOCUMENTS 819,843 A * 5/1906 Bloomer ..... B61B 12/02 104/180
3,090,497 A * 5/1963 Hite ..... B61B 7/02 212/120
3,805,706 A * 4/1974 Bancel ..... B61B 12/06 474/120
4,098,196 A * 7/1978 Weihe, Jr. ..... B61B 11/00 104/173.2
4,226,187 A * 10/1980 Paulsen ..... B61B 7/04 104/115
4,492,168 A * 1/1985 Cellai ..... B61B 12/02 105/153
4,811,669 A * 3/1989 Dahlman ..... B61B 9/00 105/141
4,920,892 A * 5/1990 Pesek ..... B61B 12/02 104/178
5,205,219 A * 4/1993 Groskreutz ..... B61B 11/002 104/173.2
6,295,936 B1 * 10/2001 Dahlstrom ..... B61B 12/127 104/173.2

(Continued)

FOREIGN PATENT DOCUMENTS

FR 2979315 A1 * 3/2013 ..... B61B 7/06
GB 2568970 A * 6/2019 ..... A63C 17/00
KR 20180089913 A * 8/2018

*Primary Examiner* — S. Joseph Morano
*Assistant Examiner* — James William Jones

(57) ABSTRACT

A portable line ascending device to enable users to ascend an incline on sliding or rolling sporting by travelling up an anchored line with the line ascending device. The device includes a mount, a plurality of sheaves connected to the mount, a motor driving the plurality of sheaves, and a power supply to supply electricity to the motor. The plurality of sheaves are configured to enable a line to be wound around at least a portion of each sheave of the plurality of sheaves and operable to engage the line to pull the line through the plurality of sheaves such that the line ascending device travels along the line.

13 Claims, 14 Drawing Sheets

(56) References Cited

U.S. PATENT DOCUMENTS

| | | | | |
|---|---|---|---|---|
| 7,448,597 | B2 * | 11/2008 | Jacobson | B66B 9/00 254/371 |
| 8,146,732 | B2 * | 4/2012 | Crafton | F04B 19/16 198/643 |
| 9,358,408 | B2 * | 6/2016 | Hua | A62B 1/06 |
| 11,325,620 | B2 * | 5/2022 | Roy | B61B 11/002 |
| 2003/0047107 | A1 * | 3/2003 | Thomas | B61B 11/002 104/173.2 |

* cited by examiner

PORTABLE LINE ASCENDING DEVICE FOR SLIDING OR ROLLER SPORTS

TECHNICAL FIELD

The disclosure relates generally to portable line ascending devices, and more particularly to portable devices to pull a person on sliding or rolling sporting equipment up an incline by travelling upon an anchored rope.

BACKGROUND

Backcountry skiing is a popular sport in which skiers climb up a snowy slope, usually ungroomed, then ski down it. Climbing up an ungroomed snow slope is often time consuming and requires significant physical exertion. Hence if a skier wants to get more vertical skiing in, he or she will have to climb back up the slope.

Similarly, downhill skateboarding is also a popular sport in which skateboarders climb up a paved sloped portion of road and then coast down upon it while riding their skateboards. Hence if a skateboarder wants to get more coasting in, he or she will have to climb back up the paved slope.

It would be advantageous for the skier or skateboarder to have a portable device that is capable of pulling a person on sliding or rolling sports equipment up an incline by travelling upon a rope anchored to the top of the slope.

SUMMARY

The present invention provides a portable device that is capable of pulling a person on sliding or rolling sports equipment up an incline by travelling upon a line anchored to the top of the slope. The device of the present invention propels itself and a load along a line or a rope (or other similar elongate member) that is fixed at one end at the top of the slope. The device can be removed from and locked onto the rope at any point along the length of the rope. For example, when using the device for backcountry ski touring, the skier fixes the end of the rope at the top of their desired run, skis down to any point along the rope, and then returns to top of their run by using the device. This allows ski tourers to enjoy more downhill runs in their time on the mountain. It is an alternative to snowmobiles for backcountry skiers that want to ski more downhill runs in a day than would be possible by repeatedly climbing up their desired run using human power alone.

Accordingly, in some aspects the present invention provides a line ascending device for use with a line.

A line ascending device for use with a line, the line ascending device includes a mount, a plurality of sheaves connected to the mount, a motor driving the plurality of sheaves and a power supply to supply electricity to the motor. The plurality of sheaves are configured to enable the line to be wound around at least a portion of each sheave of the plurality of sheaves and operable to engage the line to pull the line through the plurality of sheaves such that the device travels along the line.

In some embodiments, the plurality of sheaves are rotated to produce a synchronized tangential velocity across the plurality of sheaves to provide a uniform pull of the line through the plurality of sheaves. The preferred synchronized tangential velocity may be approximately 1.0-3.5 m/s.

In some embodiments, the line ascending device also includes a handle connected to the mount. The handle may also be removable from the mount.

In some embodiments, the plurality of sheaves is arranged in an alternating manner such that when the line is set in position, the line follows a winding path between the plurality of sheaves.

In some embodiments, the plurality of sheaves is arranged in an alternating manner such that when the line is set in position, the line follows a switchback path between the plurality of sheaves.

In some embodiments, the line ascending device also includes a gripping member operable to press the line against one sheave of the plurality of sheaves to provide grip on the line. The gripping member may be movable and lockable between an open position that enables the line to be released from the one sheave and a closed position in which the line is pressed against the one sheave. The gripping member further includes a gripping wheel.

In some embodiments, the line ascending device also includes a gear box to reduce a speed of rotation of the motor. The gear box includes a planetary gear mechanism.

In some embodiments, the plurality of sheaves have teeth for gripping the line.

In some embodiments, the plurality of sheaves comprises of a pair of upper sheaves horizontally offset from a pair of lower sheaves such that the line running through the plurality of sheaves follows a winding switchback path.

In some embodiments, the line ascending device also includes a sheave border cover, the sheave border cover having an inclined slope, wherein if and when the line slides out of a sheave of the plurality of sheaves, the sheave border cover guides the line back into the sheave.

In some embodiments, the line ascending device also includes a throttle operably coupled to the motor to control an output speed of the motor.

In some embodiments, the line ascending device also includes a line guide system. The line guide system comprises at least one guide block having a slot in alignment with a groove in a first sheave of the plurality of sheaves. The line guide system may further include an idler sheave in between the at least one guide block and the first sheave, the idler sheave being configured to provide tension and to guide the line the groove in the first sheave.

Further details of these and other aspects of the subject matter of this application will be apparent from the detailed description included below and the drawings.

DESCRIPTION OF THE DRAWINGS

Reference is now made to the accompanying drawings, in which.

DETAILED DESCRIPTION

The following disclosure relates to a line ascending device to be used with a line.

Aspects of various embodiments are described in relation to the figures.

Figure 1:
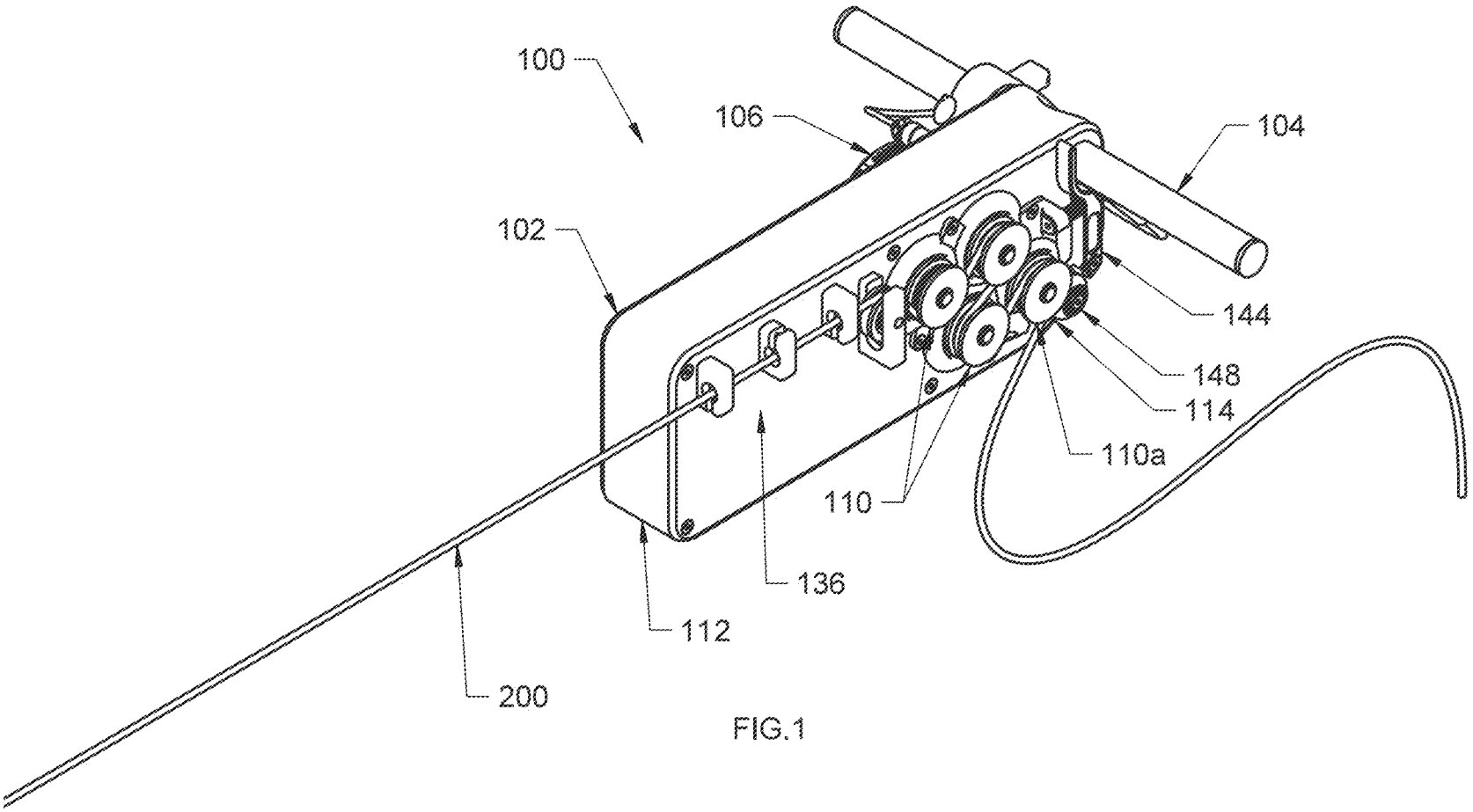
FIG. 1 is a perspective frontside view of an embodiment of a line ascending device for use with a line.

FIG. 1 is an embodiment of a line ascending device 100 (referred to hereinafter as ascending device 100). Ascending device 100 includes a mount 102, a handle 104 connected to mount 102, a power supply 108 operably connected to a motor controller 107, a motor 106 connected to motor controller 107, and a plurality of sheaves 110 connected to mount 102 and driven by motor 106. Plurality of sheaves 110 is configured to enable a line 200 to be wound around at least a portion of each sheave of the plurality of sheaves 110 and operable to engage line 200 to pull line 200 through from the front 112 of ascending device 100 to the back 114 of ascending device 100, such that ascending device 100 travels along line 200.

While line 200 could be any kind of line (e.g., a rope, cord, cable, wire, or any length of material serving a similar purpose), it is preferred that line 200 being used with ascending device 100 is a thin, compressible, technical rope. It is to be noted that line 200 is a part of the cooperating environment for ascending device 100 and does not form a part of ascending device 100 itself.

Figure 2:
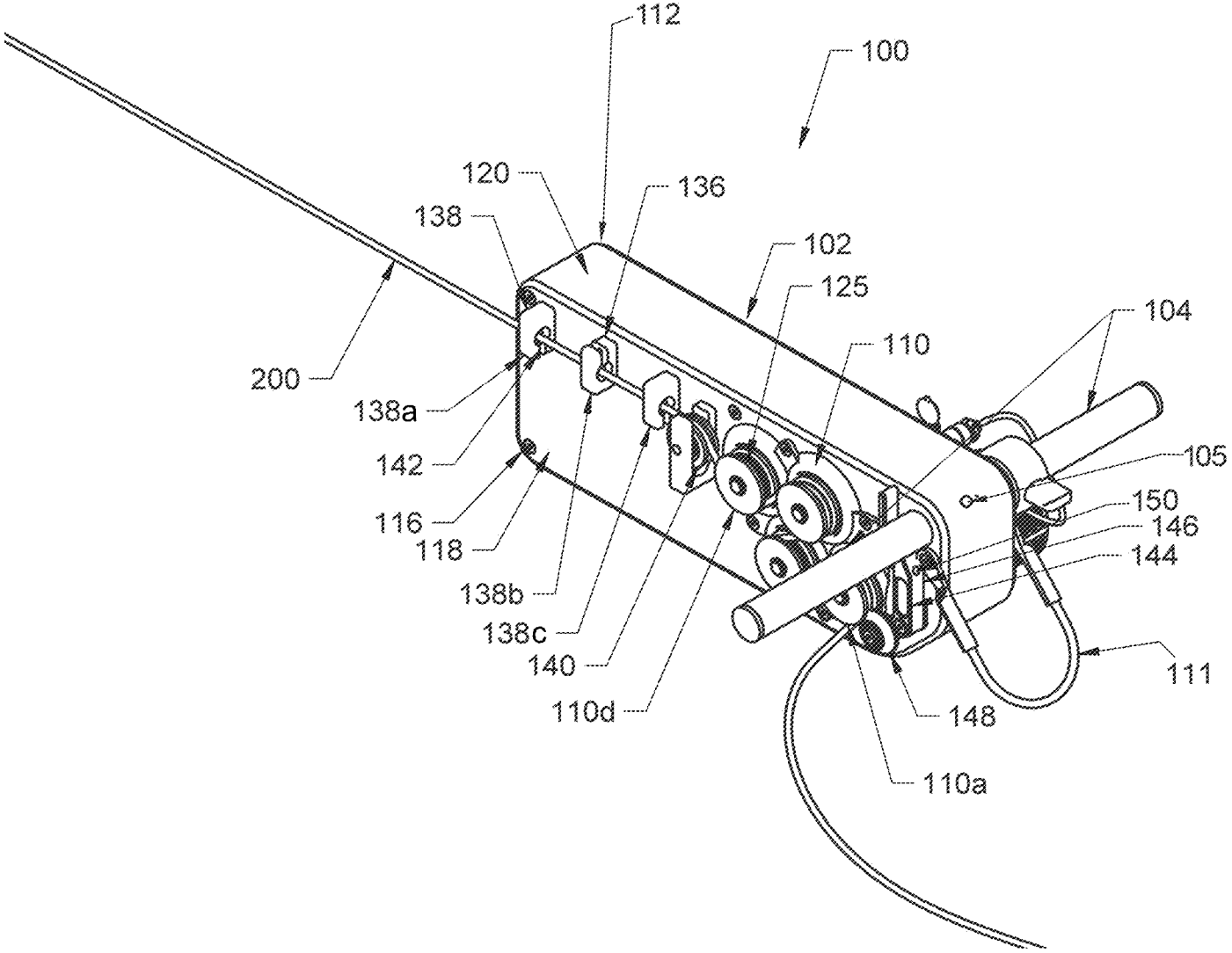
FIG. 2 is a perspective backside view of the embodiment of the line ascending device for use with a line of FIG. 1.
Figure 3:
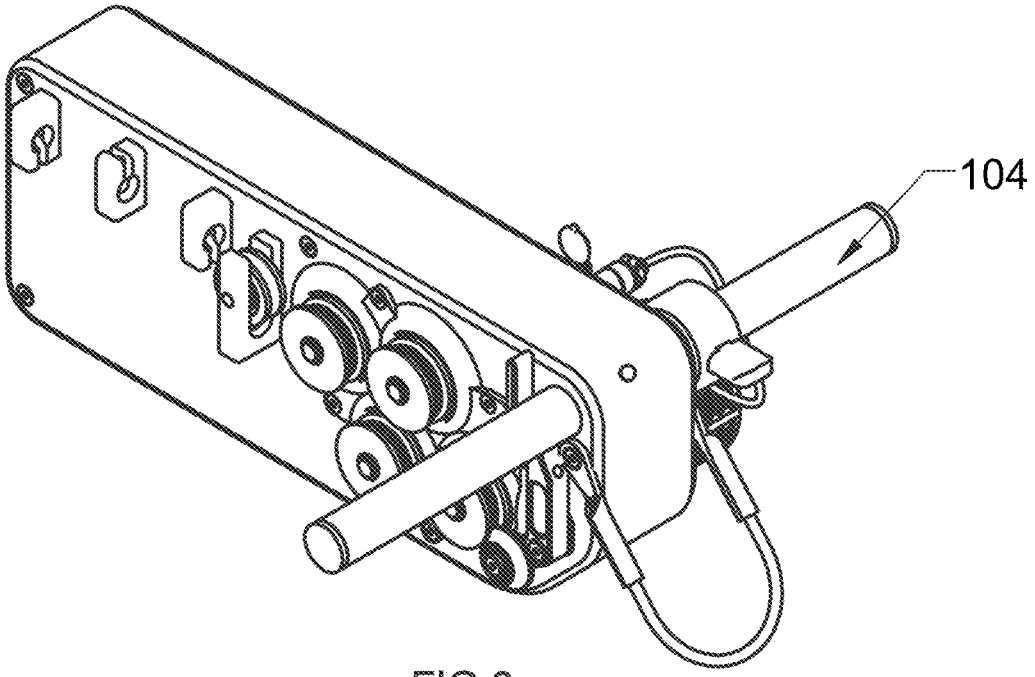
FIG. 3 is a perspective backside view of the embodiment of the line ascending device for use with a line of FIG. 1.
Figure 4:
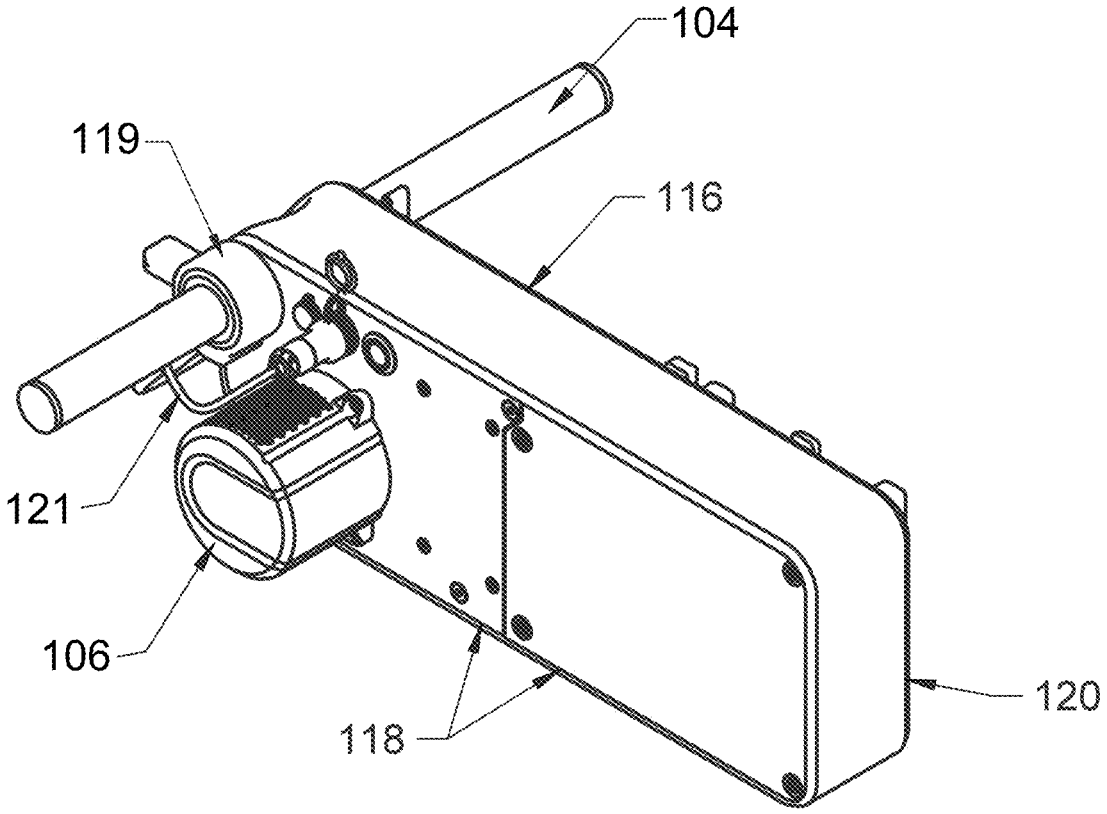
FIG. 4 is a perspective frontside view of the embodiment of the line ascending device for use with a line of FIG. 1.

Referring to FIG. 2, mount 102 is an enclosed housing 116. Enclosed housing 116 includes at least two side plates 118 mounted to a sidewall 120 (at least one side plate 118 on each side). As shown in FIG. 2, sidewall 120 is a single continuous molded piece. However, it will be understood that sidewall 120 could be made of any number of parts and/or sections and does not necessarily need to be one single molded piece. Referring to FIG. 4, one side of enclosed housing 116 includes two side plates 118. It will be understood by a person skilled in the art that any number of side plates 118 can be used to form enclosed housing 116.

Referring to FIG. 2, handle 104 includes one or more handles attached to mount 102. Handle 104 may also be removably attached to mount 102. A release 105 on handle 104 allows handle 104 to be slid in and out of mount 102 for a more compact storage. In some embodiments, handle 104 may be omitted and the device 100 may be attached to the user such as for example by a harness, clip and the like (not shown) that may be directly attached to the mount 102 or to lanyard loop 111.

Figure 8:
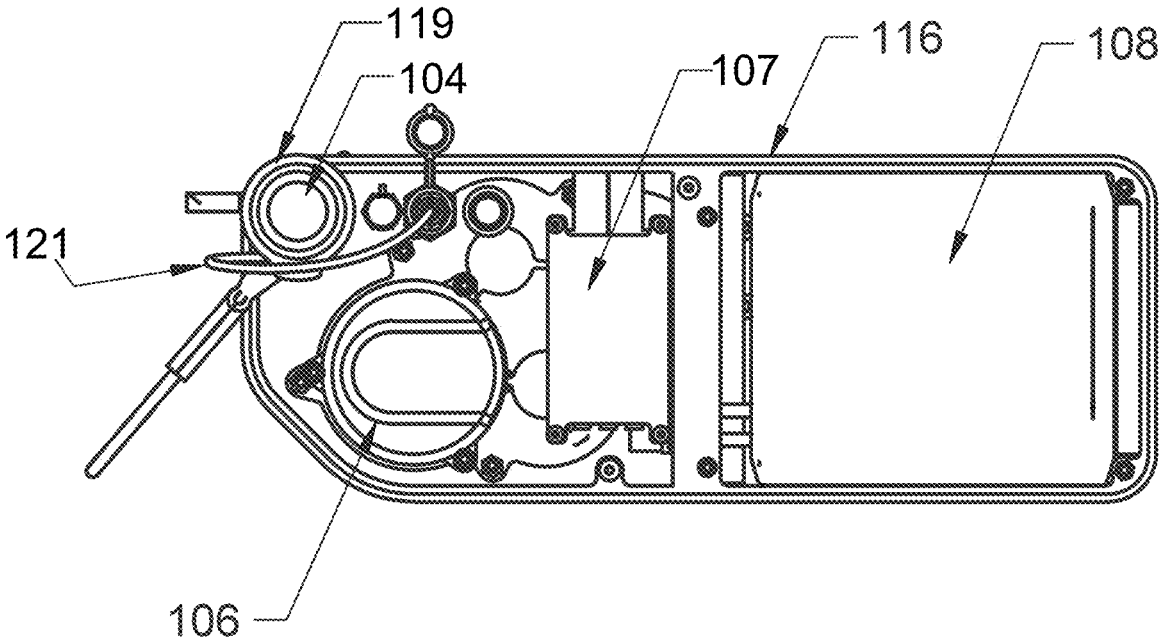
FIG. 8 is an internal right side view of the embodiment of the line ascending device for use with a line of FIG. 6.

Referring to FIG. 8, power supply 108 is contained within housing 116 and is connected to and supplies electricity to motor 106 via a motor controller 107. As illustrated in FIG. 8, power supply 108 is a battery. However, a person skilled in the art will understand that any suitable power supply may be used. Power supply 108 is controlled by a power switch 115.

Figure 5:
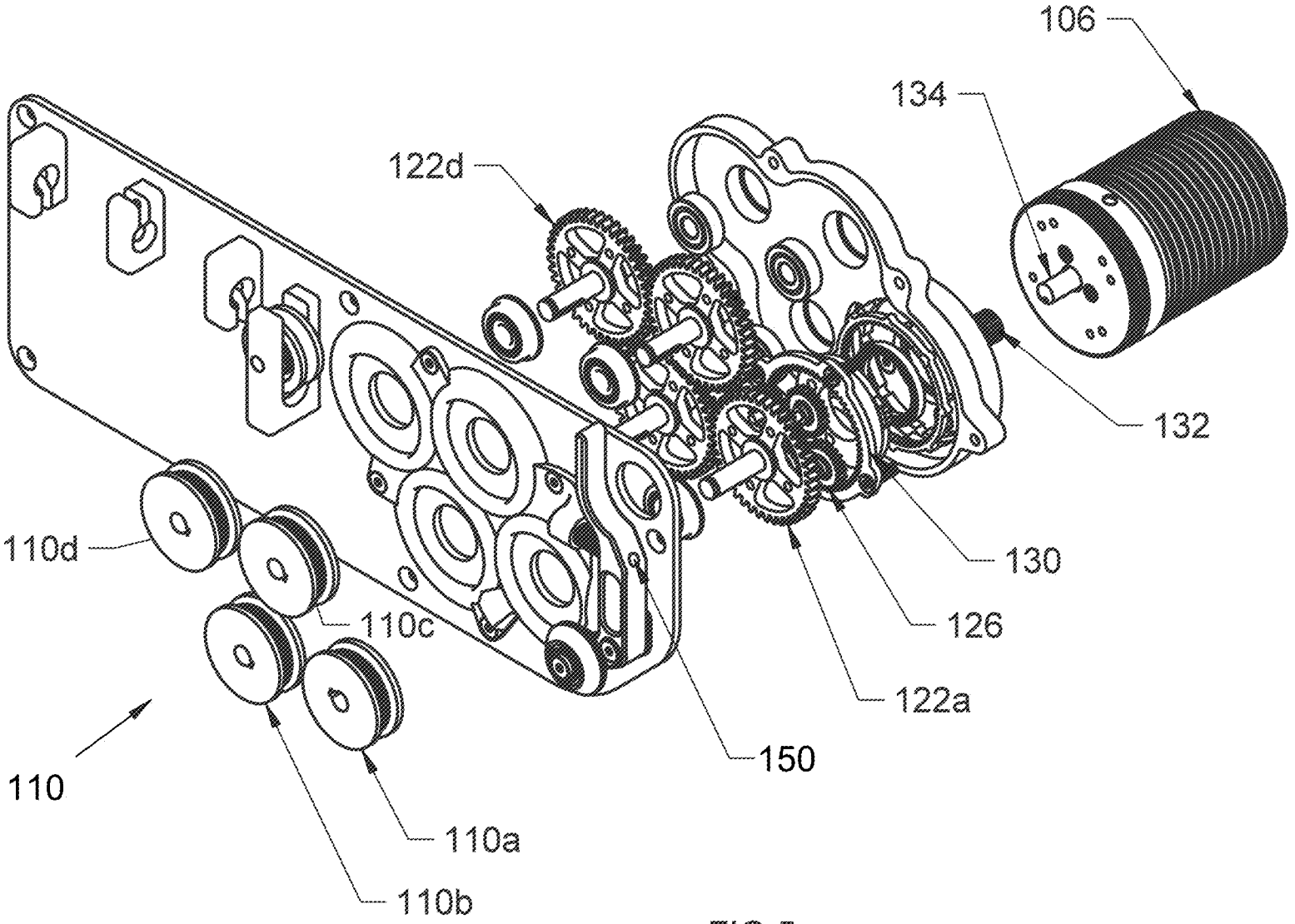
FIG. 5 is an internal exploded perspective backside view of the embodiment of the line ascending device for use with a line of FIG. 3.
Figure 6:
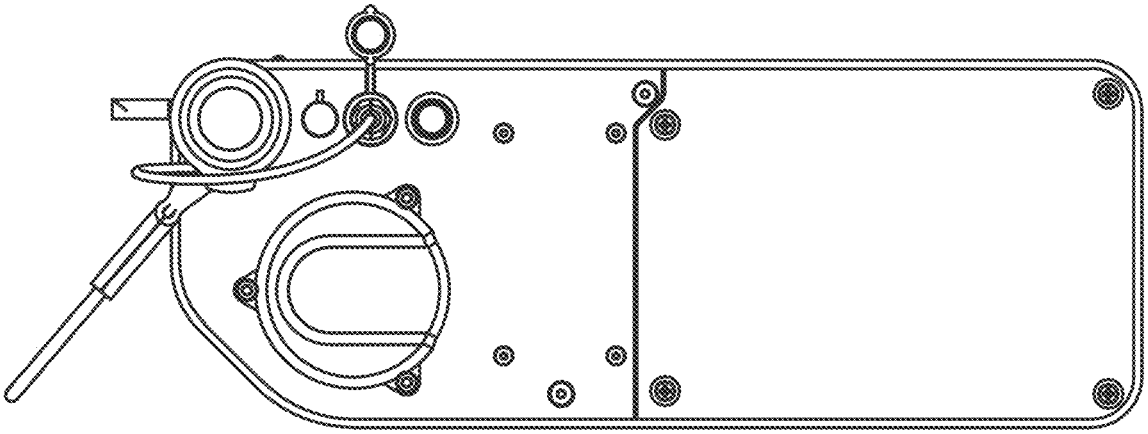
FIG. 6 is a right side view of the embodiment of the line ascending device for use with a line of FIG. 4.
Figure 7:
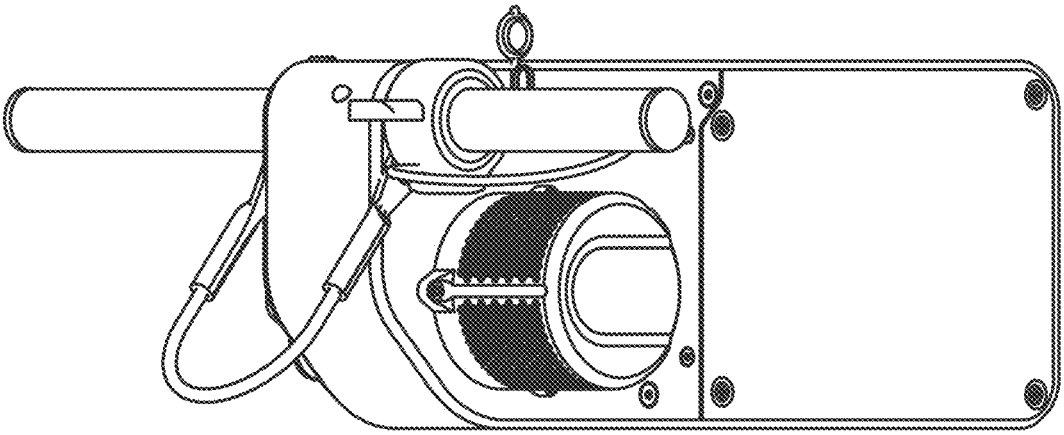
FIG. 7 is a perspective right side view of the embodiment of the line ascending device for use with a line of FIG. 6.

Referring FIG. 5, motor 106 drives the plurality of sheaves 110. Motor 106 may be a brushless variable speed DC motor having a speed constant of about 149 kV, however the motor 106 may be one having a speed constant between about 100 kV to about 300 kV. It would be apparent to a person skilled in the art from the disclosure herein to alter the gearing and/or sheave size to achieve a desired speed and torque based on the specific motor 106 used. Referring to FIG. 4 and FIG. 8, a throttle control 119 is located on handle 104 and operably coupled via a wire 121 to motor controller 107. Motor controller 107 controls an output speed of motor 106. Throttle control 119 may be an electric thumb throttle that is removably mounted on the handle 104. Throttle control 119 may be slid off handle 104 when handle 104 is removed from mount 102.

Figure 9:
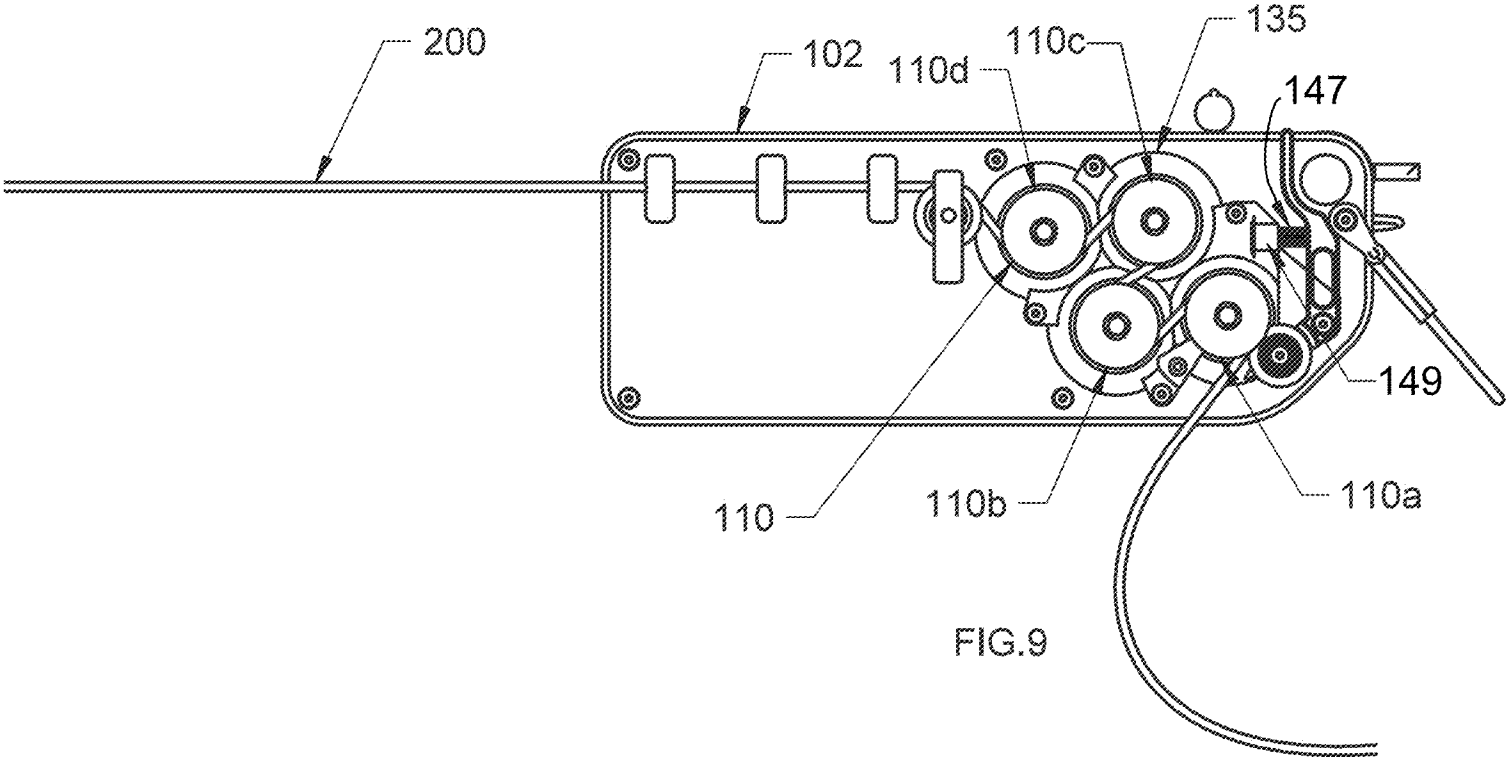
FIG. 9 is a left side view of the embodiment of the line ascending device for use with a line of FIG. 1.

Referring to FIG. 2, plurality of sheaves 110 includes four sheaves. Each sheave of the plurality of sheaves 110 has teeth 125 for gripping line 200. Referring to FIG. 9, plurality of sheaves 110 is arranged in an alternating manner such that when line 200 is set in position, line 200 follows a winding path between the plurality of sheaves 110. Preferably, plurality of sheaves 110 is arranged in such a manner that when line 200 is set in position, line 200 follows a switchback path between the plurality of sheaves 110. This is accomplished by setting two sheaves (110*a* and 110*b*) below another two sheaves (110*c* and 110*d*) in an offset fashion as illustrated in FIG. 9.

Figure 10:
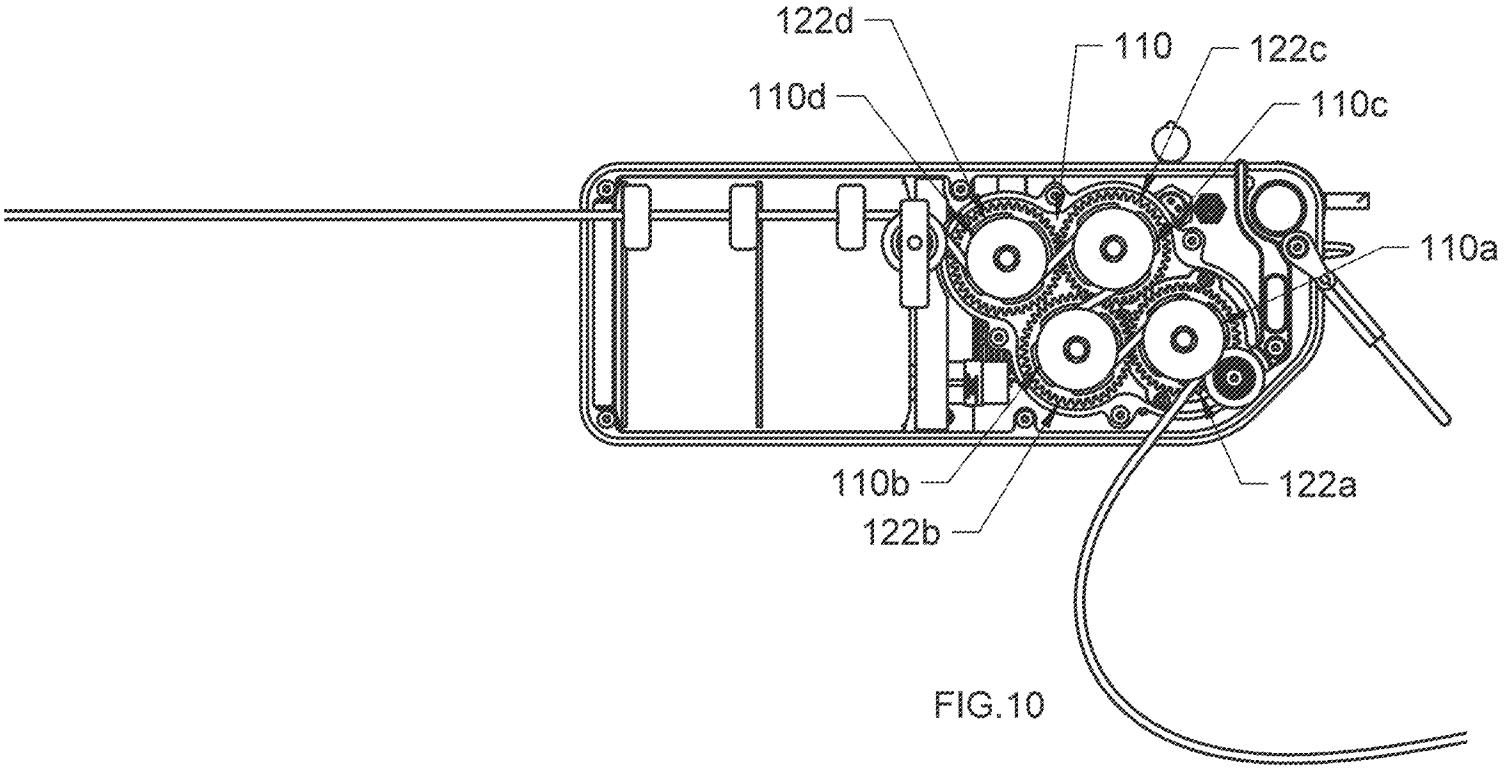
FIG. 10 is an internal left side view of the embodiment of the line ascending device for use with a line of FIG. 9.
Figure 11:
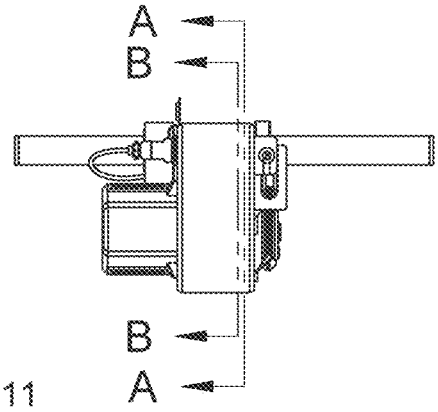
FIG. 11 is a backside view of the embodiment of the line ascending device for use with a line of FIG. 1, showing a cross-section line at line A-A and at line B-B.
Figure 12:
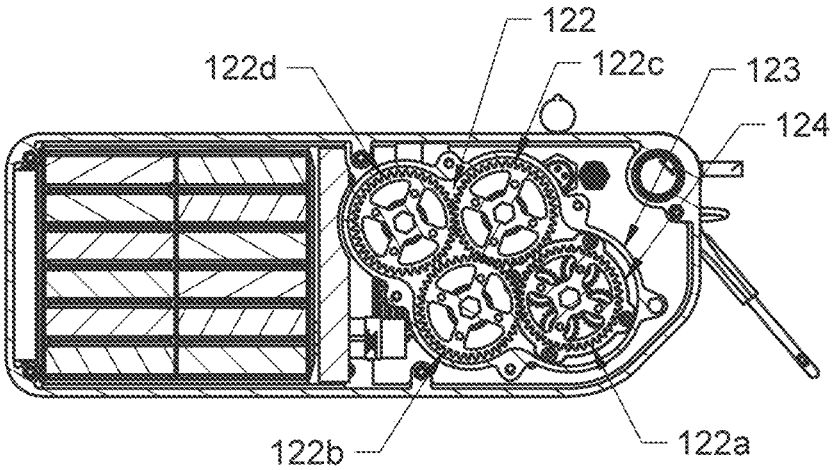
FIG. 12 is a left side cross-sectional view of the embodiment of the line ascending device for use with a line of FIG. 11, showing the cross-section view at line A-A.
Figure 13:
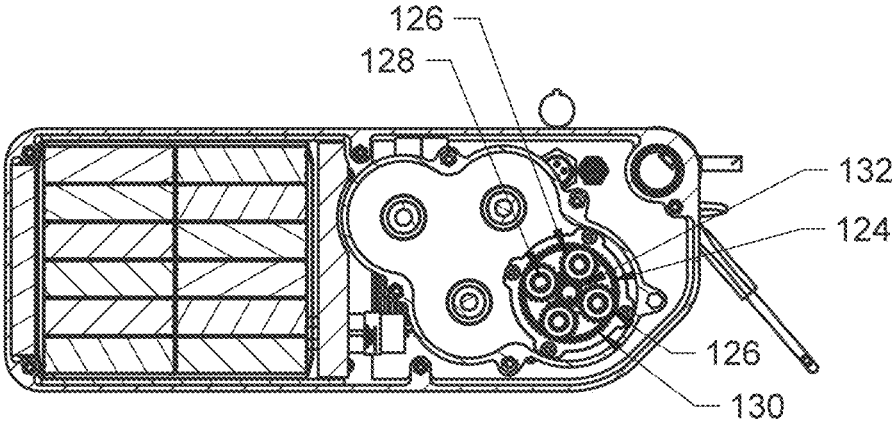
FIG. 13 is a left side cross-sectional view of the embodiment of the line ascending device for use with a line of FIG. 11, showing the cross-section view at line B-B.

Referring to FIG. 10 and FIG. 12, each sheave of the plurality of sheaves 110 is mounted to a gear 122. As illustrated, gear 122 is a spur gear. However, it will be understood that many other kinds of gears may be suitably used as would be apparent to the person skilled in the art from the present description. There are four gears (122*a*, 122*b*, 122*c* and 122*d*) each mounted to a corresponding respective sheave (110*a*, 110*b*, 110*c* and 110*d*). Referring to FIG. 12 and FIG. 13, gear 122*a* is connected to a gear box 123 to reduce the speed of rotation of the motor. Gear box 123 includes a planetary gear set 124. Planetary gear set 124 includes four planet gears 126, a ring gear 130 and a sun gear 132. Each of the four planet gears 126 has a planet gear shaft 128 that connects to gear 122*a*. Four planet gears 126 surround sun gear 132. Ring gear 130 surrounds four planet gears 126. Referring to FIG. 5, sun gear 132 is connected to motor 106 via a sun gear shaft 134. When motor 106 is turned on, it rotates sun gear shaft 134 and sun gear 132. Referring to FIG. 12 and FIG. 13, sun gear 132 then causes four planet gears 126 to rotate around sun gear 132. As four planet gears 126 rotate around sun gear 132, planet gear shafts 128 rotate gear 122*a*. Planetary gear set 124 works to reduce the angular velocity at which gears 122 turn, relative to the velocity at which motor 106 turns. The gear reduction ratio achieved by planetary gear set 124 is 4.75:1.

Referring to FIG. 10 and FIG. 12, as gear 122*a* rotates, its engagement with gear 122*b* causes gear 122*b* to rotate. As gear 122*b* rotates, its engagement with gear 122*c* causes gear 122*c* to rotate. As gear 122*c* rotates, its engagement with gear 122*d* causes gear 122*d* to rotate. As gears 122 all rotate, so does each of the plurality of sheaves 110.

All four sheaves of the plurality of sheaves 110 rotate to produce a synchronized tangential velocity. The preferred synchronized tangential velocity is approximately 1.0 to 3.0 m/s for a comfortable tow up the hill. To produce the synchronized tangential velocity of approximately 1.0 to 3.0 m/s, the plurality of sheaves 110, which have a groove diameter measured at points in the groove where the line 200 engages the sheaves of approximately 30 mm, rotate at a synchronized angular velocity of approximately 700 to 1900 rpm. Actual rpm will vary based on throttle position, load on the line and battery voltage. As illustrated, each sheave of plurality of sheaves 110 has the same sheave circumference and rotate at the same angular velocity. However, it will be understood that a synchronized tangential velocity may be achieved with sheaves of varying groove diameters and rotating at varying angular velocities. For example, if a first sheave rotates at 10 rpm, a second sheave could rotate at 20 rpm if the second sheave's groove diameter is half that of the first sheave. What is important is that the tangential velocity where each sheave of plurality of sheaves 110 contacts the line is equal across all sheaves of plurality of sheaves 110.

Although planetary gear set 126 is used in this particular embodiment, a person skilled in the art will understand that a number of different gear reducers may be used. Further, while a gear reducer may be used to provide a desired rotation speed to plurality of sheaves 110, other speed control mechanisms may be suitably used. Additionally, while the gear reduction ratio provided is 4.75:1, it will be understood that other gear reduction ratios may be suitable.

In the illustrated embodiments, at least one of the sheaves of the plurality of sheaves 110 is driven, but preferably multiple sheaves are driven by a belt or by gears. The winding switchback track of line 200 through plurality of sheaves 110 allows for the gripping force exerted by ascending device 100 on line 200 to be relatively small, similar to a capstan. Increasing the total angle by which line 200 is engaged with the driven sheaves, by increasing the number of driven sheaves, or by altering the geometry of plurality of sheaves 110 to increase the wrap angle at each driven sheave, will further reduce the required gripping force (similar to adding more turns on a capstan).

Referring to FIG. 9, surrounding plurality of sheaves 110 is a sheave border cover 135, which is mounted to mount 102. Sheave border cover 135 has an inclined slope, such that if and when line 200 slides out of a sheave of the plurality of sheaves 110, sheave border cover 135 will guide line 200 back into the sheave 110. As illustrated, sheave border cover 135 is formed of one unitary piece. However, it understandably can be formed of multiple individual pieces mounted to mount 102.

Referring to FIG. 2, ascending device 100 also includes a line guide system 136. Line guide system 136 includes three guide blocks 138 and a guide sheave 140 mounted to mount 102. Each guide block 138 has a slot 142 for receiving line 200. The first guide block 138*a* closest to front 112 of ascending device 100 has a slot 142 that opens downwards. The second guide block 138*b* following the first guide block 138*a* has a slot 142 that opens upwards. The third guide block 138*c* following the second guide block 138*b* has a slot 142 that opens downwards. Slot 142 of first guide block 138*a* aligns with a groove of guide sheave 140. Guide sheave 140 is located between third guide block 138*c* and sheave 110*d*. Guide sheave 140 is a freely rotating, non-driven, idler sheave. The alternating directions of openings for slots 142 in guide blocks 138 assists with feeding line 200 into guide sheave 140 and guide sheave 140 provides tension and guides line 200 into the groove of sheave 110*d*.

Guide sheave 140 may be used to ensure that the rope feeds into sheave 110*d* correctly and to increase the total angle by which line 200 is engaged. Further guides may also be used to ensure that line 200 feeds into the plurality of sheaves 110 correctly and does not slip off the plurality of sheaves 110.

Referring to FIG. 2, ascending device 100 also includes a gripping member 144 mounted to mount 102. Gripping member includes a lever 146 that is pivotally mounted to mount 102 and a gripping wheel 148. Gripping member 144 is located next to sheave 110*a*. Gripping member 144 is operable to press line 200 against sheave 110*a*, herein referred to as the final sheave since it is the final sheave of plurality of sheaves 110 that line 200 contacts, to provide grip on line 200. Gripping member 144 is movable and lockable between an open position that enables line 200 to be released from sheave 110*a* and a closed position in which line 200 is pressed against sheave 110*a*. Lever 146 is a spring-loaded lever that is configured to engage with line 200 of varying diameters (thickness). A first end of lever 146 is a handle for moving gripping member 144 between the open and closed positions. A second end of lever 146 holds gripping wheel 148. Lever 146 is spring biased towards the closed position by a coil spring 147 connected to mount 102 by a coil receiver 149. Referring to FIG. 5, in the closed position, a set screw 150 on lever 146 communicates with coil spring 147 to adjust the preload on coil spring 147 and accordingly adjusts the pressure of the gripping wheel 148 on line 200. Although gripping wheel 148 is used in this particular embodiment, it will be apparent to a person skilled in the art that other gripping mechanisms may used (e.g., gripping member 144 may also be a low friction glide that fits into the groove of sheave 110*a* and provides grip on line 200 by application of downward force into the groove of sheave 110*a*). However, use of gripping wheel 148 provides the advantage of providing additional grip on line 200 while still allowing line 200 to pass through with minimal friction.

Figure 14:
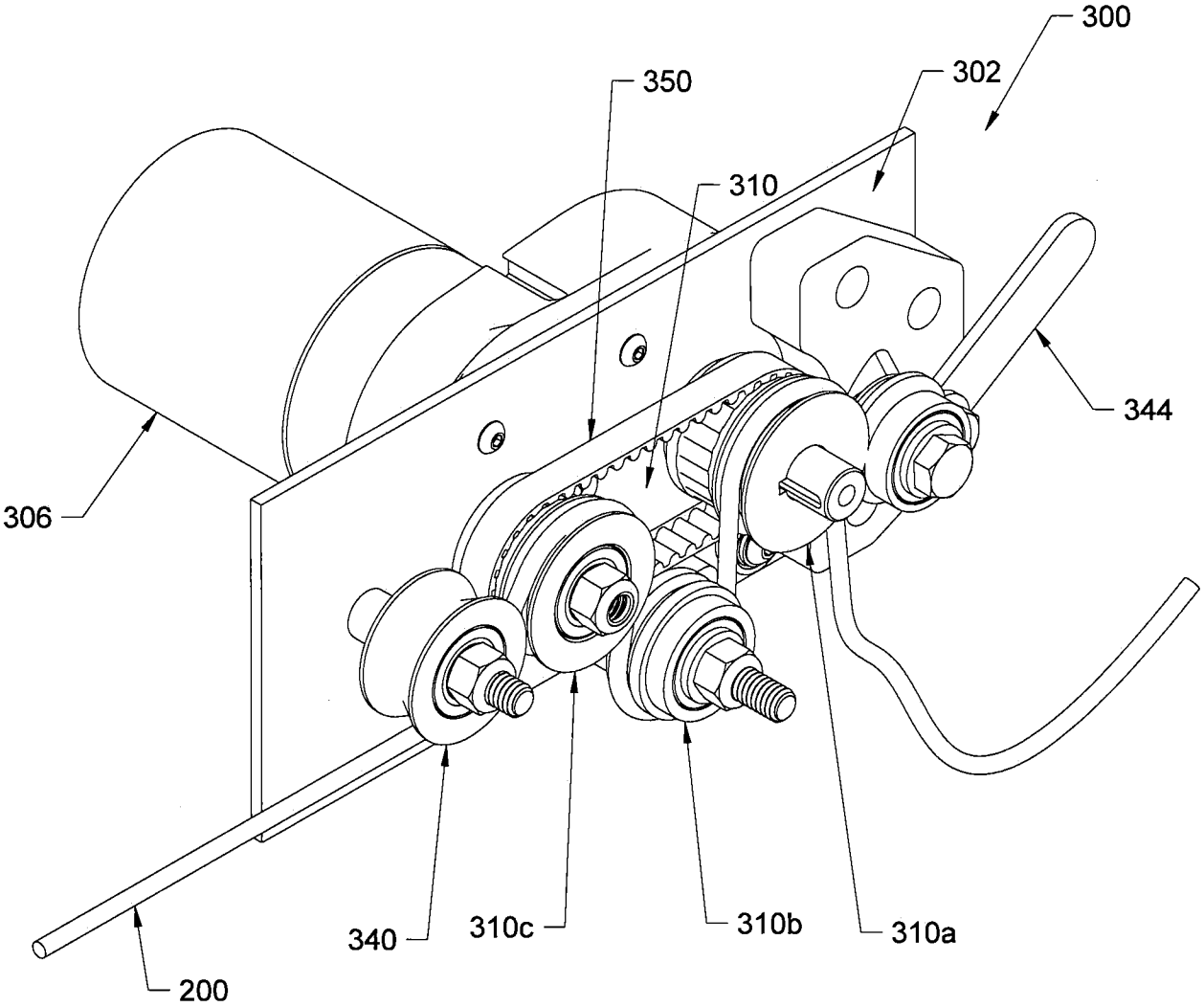
FIG. 14 is a perspective view of an alternative embodiment of the line ascending device for use with a line.

FIG. 14 is an alternative embodiment 300 of the ascending device 100. Alternative embodiment 300 includes many of the same elements as previously described. For example, alternative embodiment 300 includes a mount 302, a motor 306, a plurality of sheaves 310, a guide sheave 340, and a gripping member 344. However, plurality of sheaves 310 includes three sheaves (310*a*, 310*b* and 310*c*). Sheave 310*a* is driven by motor 306. A timing belt 350 wraps around sheave 310*a* and 310*c*. As motor 306 turns sheave 310*a*, sheave 310*a* drives timing belt 350 and timing belt 350 drives sheave 310*c*. Sheave 310*b* is an idler sheave located between sheave 310*a* and sheave 310*b*. A guide sheave 340 is a freely rotating, non-driven, idler sheave that provides tension and guides line 200 into the groove of sheave 310*c*. Plurality of sheaves 310 is arranged in such a manner that when line 200 is set in position, line 200 follows a switchback path between the plurality of sheaves 310.

Figure 15:
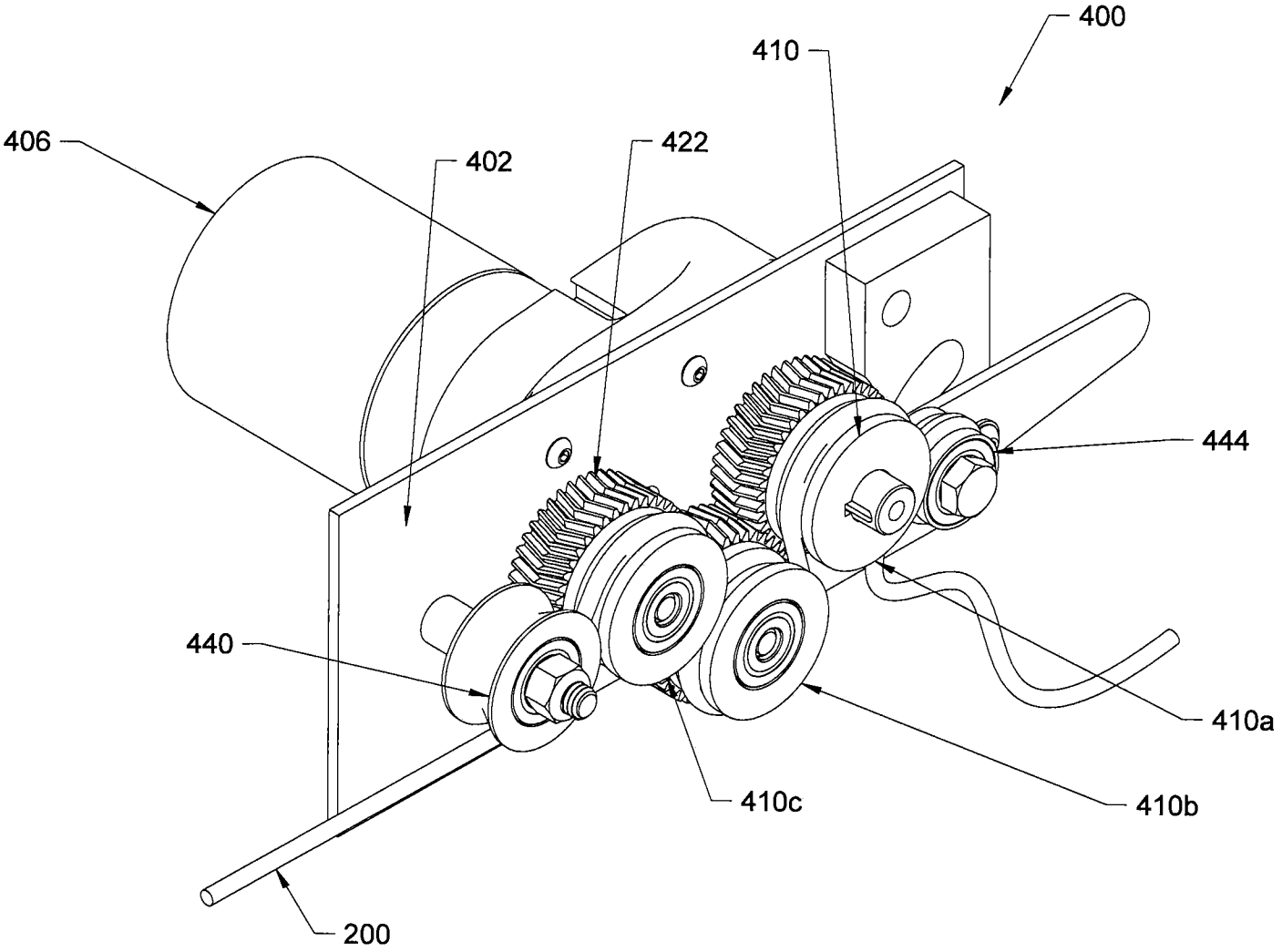
FIG. 15 is a perspective view of another alternative embodiment of the line ascending device for use with a line.

FIG. 15 is another alternative embodiment 400 of the ascending device 100. Alternative embodiment 400 includes many of the same elements as previously described. For example, alternative embodiment 400 includes a mount 402, a motor 406, a plurality of sheaves 410, a guide sheave 440, and a gripping member 444. However, plurality of sheaves 410 includes three sheaves (410*a*, 410*b* and 410*c*). Each of the plurality of sheaves 410 is connected to a gear 422. Sheave 410*a* is driven by motor 406. As sheave 410*a* rotates, its engagement with sheave 410*b* via their respective gear 422 causes sheave 410*b* to rotate. As sheave 410*b* rotates, its engagement with sheave 410*c* via their respective gear 422 causes sheave 410*c* to rotate. A guide sheave 440 is a freely rotating, non-driven, idler sheave that provides tension and guides line 200 into the groove of sheave 410*c*. Plurality of sheaves 410 is arranged in such a manner that when line 200 is set in position, line 200 follows a switchback path between the plurality of sheaves 410.

Figure 16:
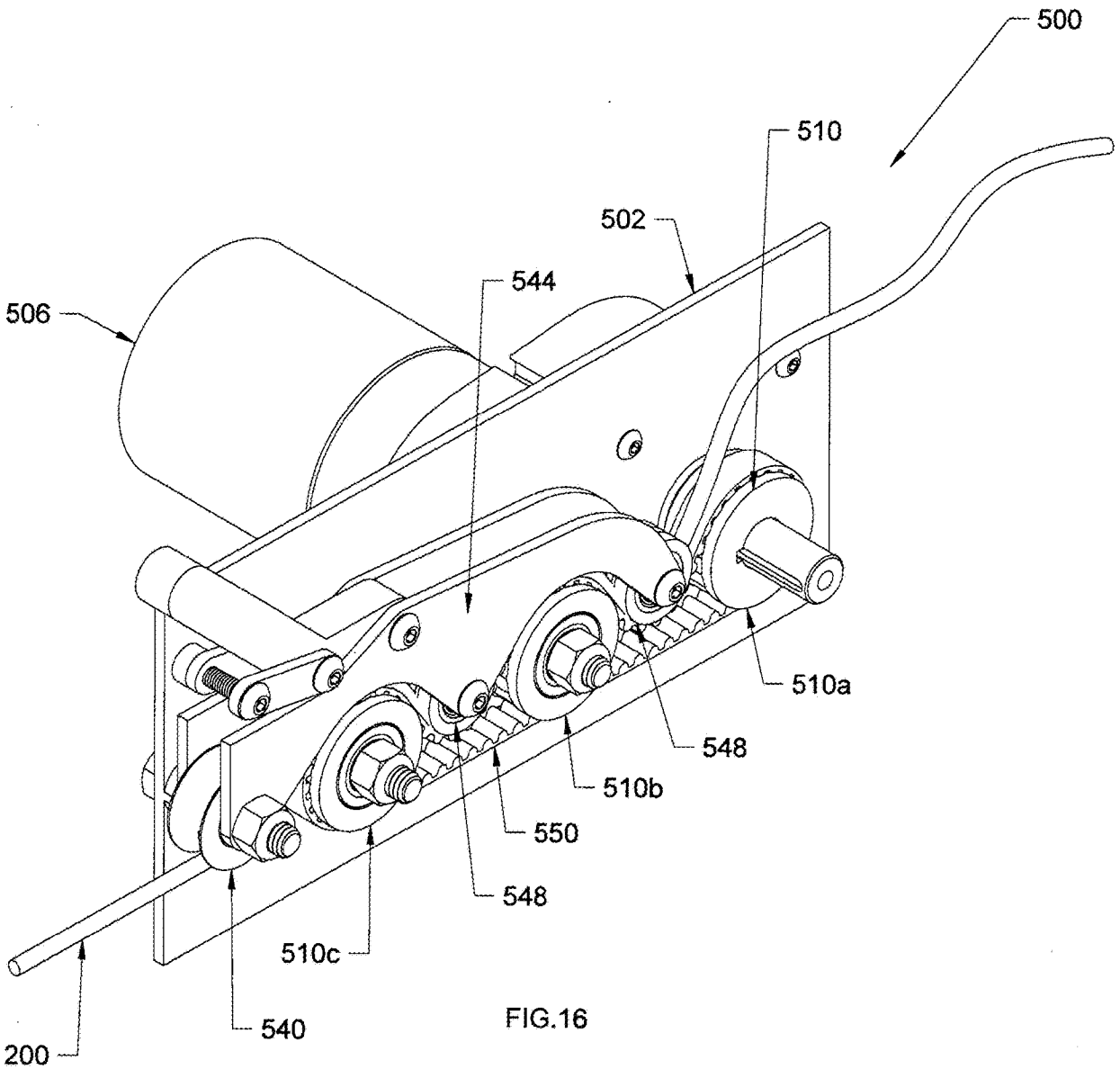
FIG. 16 is a perspective view of another alternative embodiment of the line ascending device for use with a line.
Figure 17:
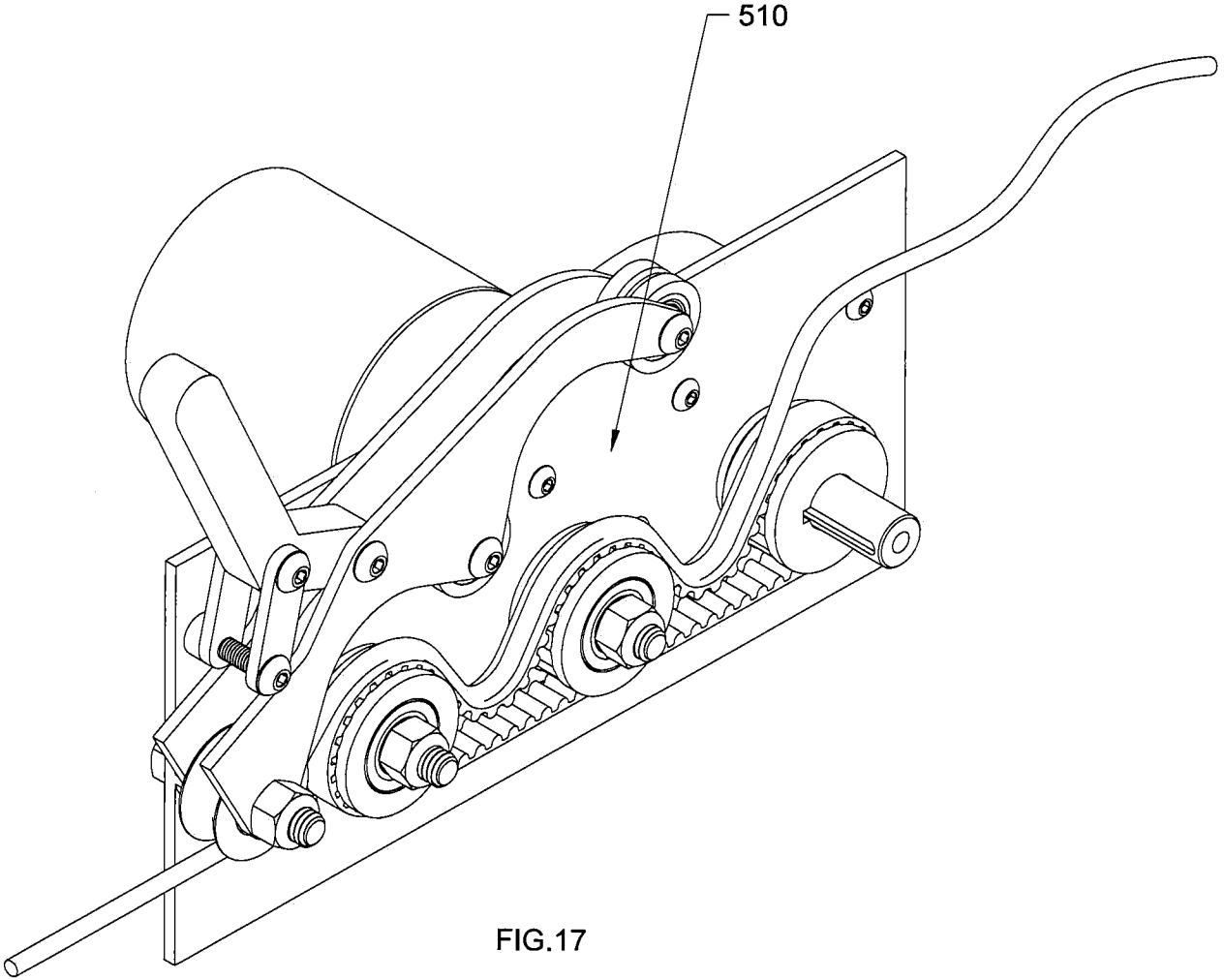
FIG. 17 is a perspective view of the alternative embodiment of the line ascending device for use with a line of FIG. 16.

FIG. 16 and FIG. 17 is another alternative embodiment 500 of the ascending device 100. Alternative embodiment 500 includes many of the same elements as previously described. For example, alternative embodiment 500 includes a mount 502, a motor 506, a plurality of sheaves 510, a guide sheave 540, and a gripping member 544. However, plurality of sheaves 510 includes three sheaves (510*a*, 510*b* and 510*c*). Sheave 510*a* is driven by motor 506. A timing belt 550 wraps around sheave 510*a*, sheave 510*b* and sheave 510*c*. As motor 506 turns sheave 510*a*, sheave 510*a* drives timing belt 550 and timing belt 550 drives sheave 510*b* and sheave 510*c*. Guide sheave 540 is a freely rotating, non-driven, idler sheave that provides tension and guides line 200 into the groove of sheave 510*c*. Plurality of sheaves 510 is arranged in a straight path such that when line 200 is set in position, line 200 follows a winding path between the plurality of sheaves 510. Gripping member 544 is located above plurality of sheaves 510. Gripping member 544 includes a lever and two gripping wheels 548. Lever 546 is pivotally mounted to mount 502 at the same location as guide sheave 540. Gripping wheels 548 are configured to fit in the space between sheave 510*a* and sheave 510*b* and between sheave 510*b* and sheave 510*c*. Gripping member 544 is movable and lockable between an open position and a closed position. Referring to FIG. 17, the open position enables line 200 to be released from plurality of sheaves 510. Referring to FIG. 16, the closed position presses and holds line 200 against plurality of sheaves 510.

Figure 18:
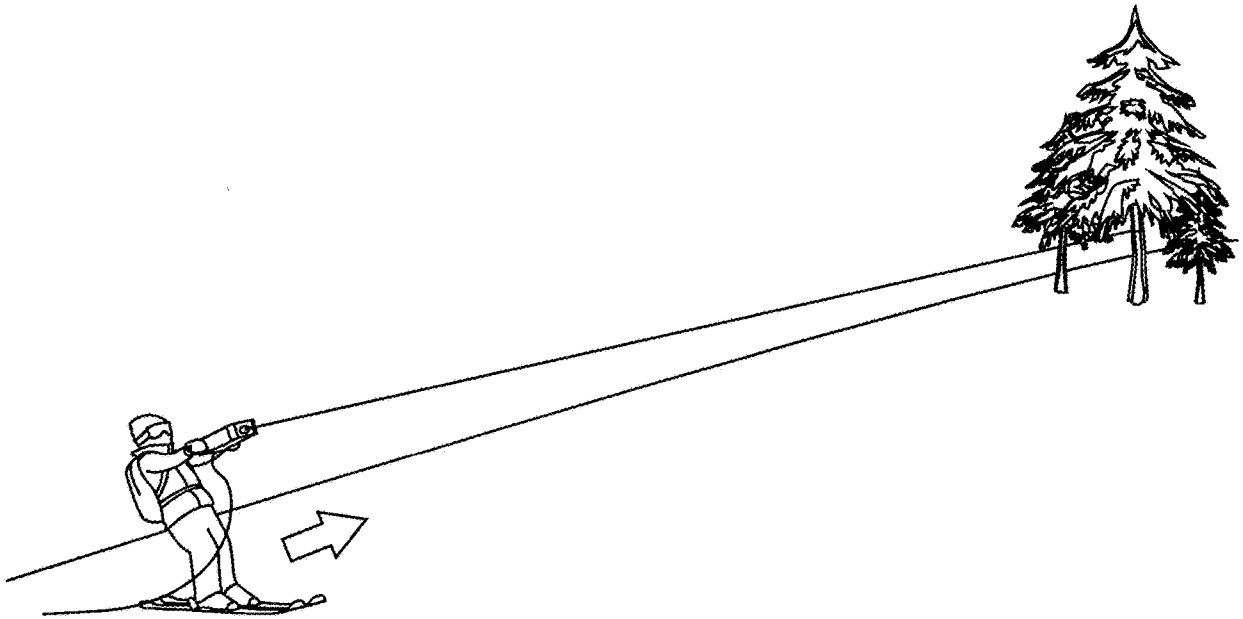
FIG. 18 illustrates an embodiment of the line ascending device of FIG. 1 in use with a line.
Figure 19:
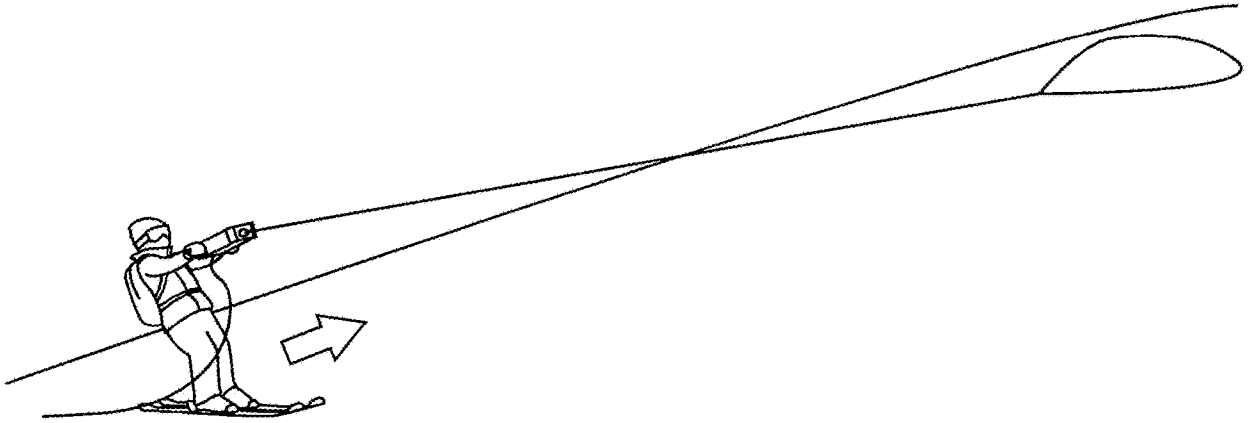
FIG. 19 illustrates an embodiment of the line ascending device of FIG. 1 in use with a line.

Referring to FIG. 1, FIG. 18 and FIG. 19, in use, a user takes line 200 that has been anchored to a tree or other stable object located up a slope that the user intends to ascend and wraps line 200 into line guide system 136 and into plurality of sheaves 110 in a winding path. It is preferred that the line is wrapped around the plurality of sheaves in a winding path with switchback turns to provide the most traction on line 200. It is to be noted that line 200 may be wrapped into plurality of sheaves 110 of ascending device 100 at any point in line 200 and does not necessarily have to be at the end of line 200. Once line 200 is set in place, the user moves gripping member 144 from the open position to the locked position, thereby pressing gripping wheel 148 and line 200 into the groove of sheave 110*a* to provide additional grip on line 200. Once line 200 has been secured in this manner, the user turns on motor 106 and holds on to handle 104. Motor 106 drives plurality of sheaves 110, which pulls line 200 through from the front 112 to the back 114 of ascending device 100 such that ascending device 100 travels along line 200. As user holds on to handle 104, the user will also travel along line 200 and resulting travel up the slope that the user intends to ascend.

An advantage of the above configuration is that method of gripping line 200 allows ascending device 100 to work easily with a small diameter rope or cable. Other rope ascending devices are typically designed for larger diameter climbing rope or sailing lines and can have problems with small diameter rope compressing and jamming in the device. Devices that use only wedges to provide traction, will not be as effective when used with metal cable or other less compressible elongate members.

Another advantage of the above configuration is that this ascending device can be attached to line 200 faster and more easily than existing rope ascending devices. Ascending device 100 does not require the loose end of a rope to be fed through it in order to attach to the rope. No wrapping around a capstan is required and the chance of a rope feeding incorrectly or losing tension is reduced. Damage and wear to the rope is minimal.

Another advantage of the above configuration is that this device can be used as an alternative to snowmobiles when used for backcountry skiing. Compared to a snowmobile, the device is less costly, more accessible (it is portable), and has a reduced environmental impact.

As can be understood, the examples described above and illustrated are intended to be exemplary only. The embodiments described in this document provide non-limiting examples of possible implementations of the present technology. Upon review of the present disclosure, a person of ordinary skill in the art will recognize that changes may be made to the embodiments described herein without departing from the scope of the present technology. Yet further modifications could be implemented by a person of ordinary skill in the art in view of the present disclosure, which modifications would be within the scope of the present technology.

What is claimed is:

1. A line ascending device for use with a line, the line ascending device comprising:

a mount;

a plurality of sheaves rotatably connected to the mount;

each sheave of the plurality of sheaves being connected to a gear member such that each sheave is rotationally driven by its gear member;

each gear member being connected to at least one other gear member to be rotationally driven by said at least one other gear member;

at least one gear member being connected to a gearbox to be rotationally driven by the gearbox;

a motor driving the gearbox;

a power supply to supply electricity to the motor;

the plurality of sheaves being coplanar and located to enable the line being wound around at least a portion of each sheave of the plurality of sheaves;

the gear members and the plurality of sheaves being configured to produce a synchronized tangential velocity across the plurality of sheaves to provide a uniform pull of the line through the plurality of sheaves; and the plurality of sheaves being operable to engage the line to pull the line through the plurality of sheaves to cause the device to travel along the line.

2. The device of claim 1, further comprising a handle connected to the mount.

3. The device of claim 2 wherein the handle is removable from the mount.

4. The line ascending device of claim 1 wherein each sheave of the plurality of sheaves has a circumferential groove for accommodating a portion of the line that is wound around the at least a portion of each sheave of the plurality of sheaves.

5. The device of claim 4, wherein:

the plurality of sheaves comprises a first sheave, at least one intermediate sheave, and a last sheave located lower than the first sheave; and the device further comprises a gripping member operable to press the line into and against the groove of the last sheave to provide a gripping force on the line to maintain the line within the groove of the last sheave.

6. The line ascending device of claim 5 wherein the gripping member comprises a gripping wheel having a rotating edge, the gripping wheel being movable between an open position in which the rotating edge is disengaged from the groove of the last sheave to enable the line to be released from the last sheave and a closed position in which the rotating edge is engaged with the line pressing the line into and against the groove of the last sheave.

7. The device of claim 6, wherein the plurality of sheaves is arranged in an alternating manner such that when the line is set in position, the line follows a switchback path commencing with the first sheave, the at least one intermediate sheave, and the last sheave.

8. The device of claim 7, wherein the plurality of sheaves comprises of a pair of upper sheaves horizontally offset from a pair of lower sheaves such that the line running through the plurality of sheaves follows a winding switchback path.

9. The device of claim 5, further comprising a line guide comprising at least one guide block having a slot in alignment with the circumferential groove of the first sheave.

10. The device of claim 9, wherein the line guide system further comprises an idler sheave in between the at least one guide block and the first sheave, the idler sheave being configured to provide tension and to guide the line into the circumferential groove of the first sheave.

11. The device of claim 4, wherein the circumferential groove has teeth for gripping the line.

12. The device of claim 1 wherein the gearbox comprises a planetary gear operable to reduce a speed of rotation of the motor.

13. The device of claim 1, further comprising a throttle operably coupled to the motor to control an output speed of the motor.

* * * * *